United States Patent [19]

Loiez et al.

[11] 4,356,795

[45] Nov. 2, 1982

[54] DEVICE FOR FIXING A PANEL OF HEAT-EXCHANGE TUBES

[75] Inventors: Jean-Louis Loiez, Lille; Jean Fournier, Rochefort en Yvelines, both of France

[73] Assignee: Stein Industrie, Velizy-Villacoublay, France

[21] Appl. No.: 223,534

[22] Filed: Jan. 8, 1981

[30] Foreign Application Priority Data

Jan. 11, 1980 [FR] France ..... 80 00582

[51] Int. Cl.[3] ..... F22B 37/06

[52] U.S. Cl. ..... 122/511; 122/510; 165/67

[58] Field of Search ..... 165/67, 68; 122/510, 122/511; 285/61

[56] References Cited

U.S. PATENT DOCUMENTS 3,545,534 12/1970 Coles et al. ..... 165/67

FOREIGN PATENT DOCUMENTS 1145648 11/1959 Fed. Rep. of Germany ..... 165/67

*Primary Examiner*—Edward G. Favors

*Attorney, Agent, or Firm*—Sughrue, Mion, Zinn, Macpeak & Seas

[57] ABSTRACT

A device for fixing a panel of horizontal heat-exchange tubes on vertical tubes 1 or beams provided with longitudinal fins 2. It includes a series of shoulders 4 having upwardly projecting rims on the fins, parts 6 which form latches having noses 9 by which they are fixed on these rims and dogs 14 installed in holes 12 in the lower portions of the parts which form latches. The shoulders, the parts which form latches and the dogs co-operate to prevent the panel of tubes from being detached when it is positioned.

5 Claims, 3 Drawing Figures

DEVICE FOR FIXING A PANEL OF HEAT-EXCHANGE TUBES

The present invention relates to a device for fixing a panel of horizontal or slightly inclined heat-exchange tubes on vertical tubes or beams provided with longitudinal fins.

BACKGROUND OF THE INVENTION

Such panels have already been fixed by means of collars formed around the tubes supported by and welded to the vertical tubes or beams, or by means of one-piece cradles between the tubes or the support beams and the tubes supported thereon or welded thereto, or by means of distance pieces or spaces formed in two parts which slide in each other, one of these parts being welded to the vertical tubes or beams, the other part being welded to the supported tubes.

Such fixing devices require careful preparation of the panel on a former and possibly a large number of welding operations. The connecting parts formed between the vertical tubes or beams and the horizontal tubes often include relatively small sections of contact with the horizontal tubes so that the sections are not properly cooled by the fluid which circulates in the horizontal tubes and that excessive thermal stresses may appear at the connection piece-to-tube link and cause breakage of the tube. Further, if there are vibrations in the panel of tubes during operation, stresses are concentrated at the rigid connections between the supported tubes and the support. This can cause breakage of tubes.

The present invention aims to remedy these drawbacks and to provide a device for fixing such panels of tubes which does not require very careful positioning of the tubes on a former, is simple and rapid to fix, requires pratically no welding operation and which allows the use of relatively simple intermediate parts which do not require very great manufacturing precision.

SUMMARY OF THE INVENTION

The device according to the invention includes:

a/ lateral notches defining a series of shoulders on the longitudinal fins of each vertical tube or beam, said shoulders having upwardly projecting rims;

b/ a series of parts which form latches whose upper surfaces are substantially plane on one side and rise on the other side in a cylinder with a radius of curvature equal to or slightly greater than that of the radius of a horizontal tube, the parts which form latches having, under the substantially plane sides of their upper surfaces, noses which are separated from the middle portions by recessed portions which fit into the projecting rims of the shoulders , vertical shoes in planes at 90° to the planes of vertical symmetry of said parts, said shoes being nearly as high as the rims of the shoulders and having in their bottoms holes whose axes are perpendicular to their planes; and c/ a series of dogs whose dimensions are such as to allow them to be installed in said holes of the parts which form latches, each dog having legs whose height is such that their ends come into contact with the upper portion of a horizontal tube which rests on the upper surface of the part which forms a latch immediately below, and a side rim in its upper portion such that when urged upwards, the dog abuts against the lower surface of the shoulder on which the part which forms a latch is fixed, the dog engaging in a hole in the shoulder.

Further, it preferably includes at least one of the following features:

The vertical spacing of two shoulders, the width of the cylindrical outer portion of the upper shoe of a part which forms a latch and the height of the legs of a dog are such that a tube cannot become unfixed from said fixing device under the effect of a force which tends to move it away from the vertical tube beam without the upper side rim of dog abutting against the lower surface of the corresponding shoulder, and wherein the height of the legs of a dog is such that the clearance between the side rim of said dog and the lower surface of the shoulder is at the most equal to half the contact height of the nose of the part which forms a latch with the lip of the shoulder.

The vertical shoe of each part which forms a latch is provided with two flanges by which it straddles the sides of the shoulder on which said part which forms a latch is fixed.

The dogs are made of a substance which is consumable at the temperature of the enclosure in which the panel of tubes is required to operate.

Above the place occupied by the highest horizontal tube it includes a part with a concave cylindrical lower profile whose radius of curvature is substantially equal to that of the horizontal tube, said part being welded on the fin of the vertical tube or beam so as to lock the panel of horizontal tubes in position.

BRIEF DESCRIPTION OF THE DRAWINGS

A device for fixing a panel of horizontal heat-exchange tubes or a vertical support tube is described hereinafter by way of example and with reference to the figures of the accompanying drawings.

DETAILED DESCRIPTION

Figure 1:
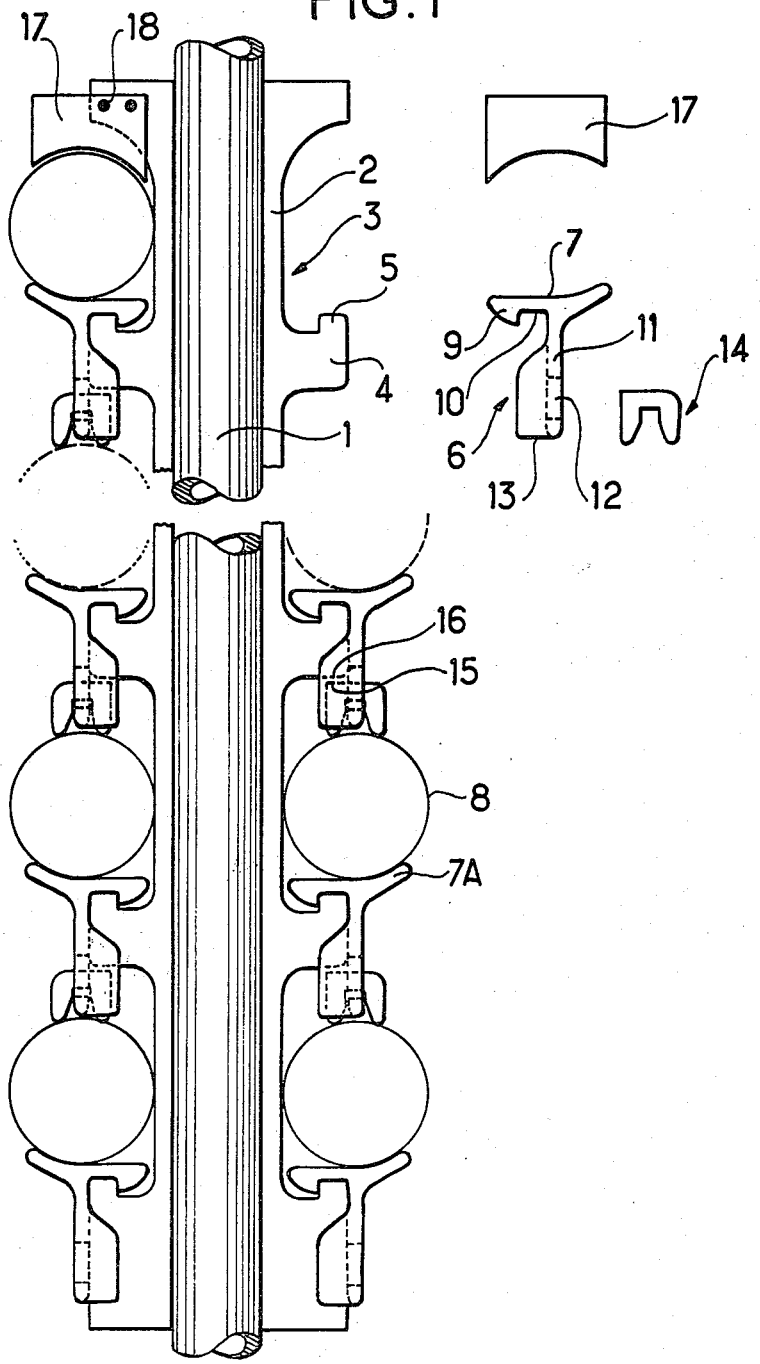
FIG. 1 is an exploded elevational view which illustrates a profile of a few horizontal tubes of a panel fixed on shoulders on fins of a vertical tube and a part which forms a latch and a dog separated from the device.
Figure 2:
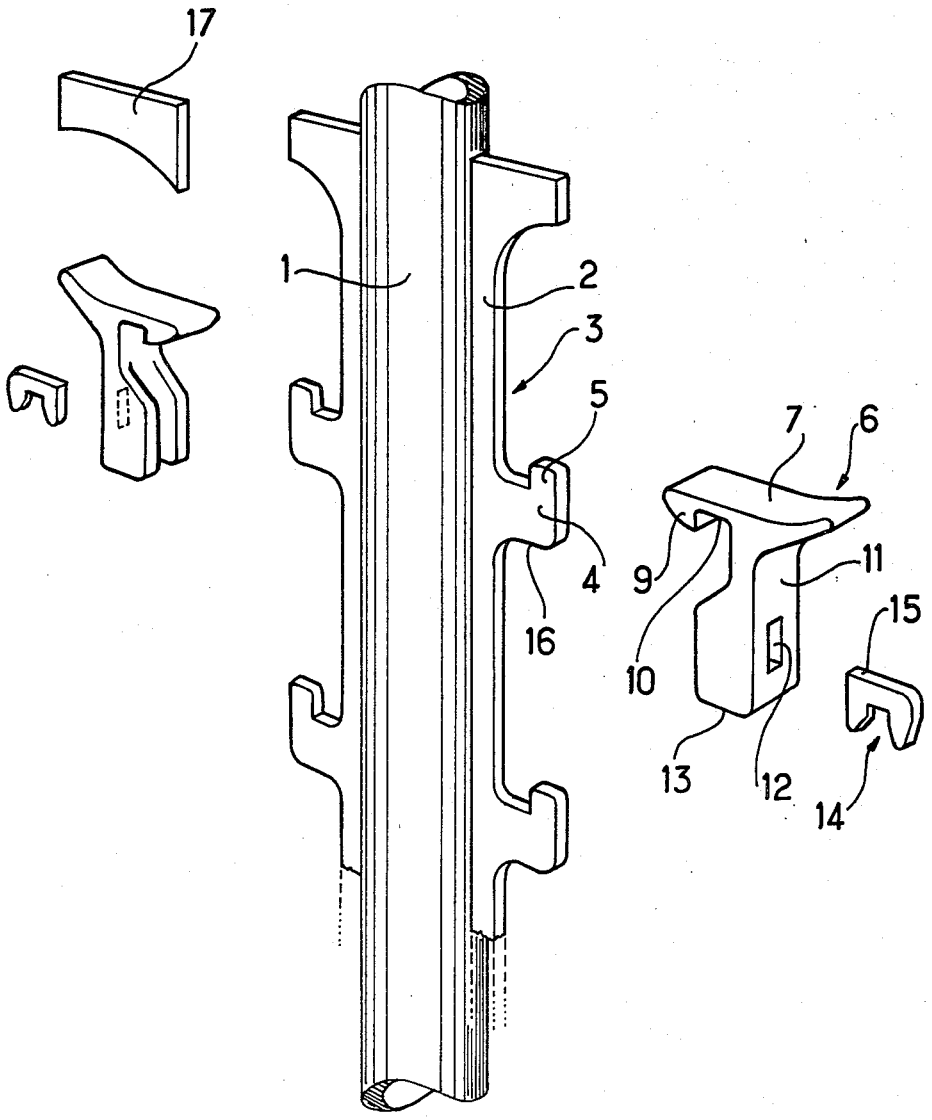
FIG. 2 is an exploded perspective view corresponding to the upper portion of the device of FIG. 1 and illustrating two tube supports with dogs and parts which form latches.

In FIGS. 1 and 2, a vertical tube 1 has vertical fins 2 welded to opposite sides of the tube. These fins are cut out by punching notches such as 3 which separate them from shoulders 4 with upturned protruding lips 5.

Part 6 forms a latch with an upper surface 7 which is substantially flat on the side turned towards the vertical support tube and which rises on the other side, having a curvature matching the periphery of a cylinder whose radius of curvature is equal to that of a horizontal tube such as 8 so as to prevent the horizontal tube from rolling away from the vertical tube. The width of the upper surface 7 is determined in conjunction with the depth of the notches 3 so that installed tubes come into contact with the bottoms vertical of the notches. Below the flat side of the upper surface, the part which forms a latch is provided with a nose 9 separated from the middle portion by a recessed portion 10 whose width corresponds to that of the lip 5 of a shoulder 4 so as to fit exactly thereon. It also has a vertical shoe 11 which is intended to be applied against the side of lip 5 of the shoulder 4. Each shoe 11 has a rectangular hole 12 in a lower portion, between two flanges 13 which are intended to lie against both side surfaces of the shoulders 4. The hole 12 is for inserting a dog 14 whose legs, once it is positioned, rest on the upper periphery of the horizontal tube immediately therebelow. A side rim 15 of each dog protrudes sufficiently to abut against the lower edge 16 of the corresponding shoulder and thus to block the corresponding tube in the event it is urged upwards, this tending to disconnect it during positioning.

Two parts such as 17 whose lower edges have concave cylindrical profiles causes the highest horizontal tubes of a panel and consequently the set of tubes of the panel to be locked in position after being welded at a few points such as 18, FIG. 1, onto the corresponding portion of a fin on the vertical tube. Once the tubes of a panel are installed and the parts 17 are welded onto the fins of the vertical tube 1, the dogs 14 are no longer necessary to hold the tubes of the panel in position. They can be made of a substance which burns at the temperature of the combustion gases which come into contact with the panel of tubes and, for example, of a thermoplastic substance.

Figure 3:
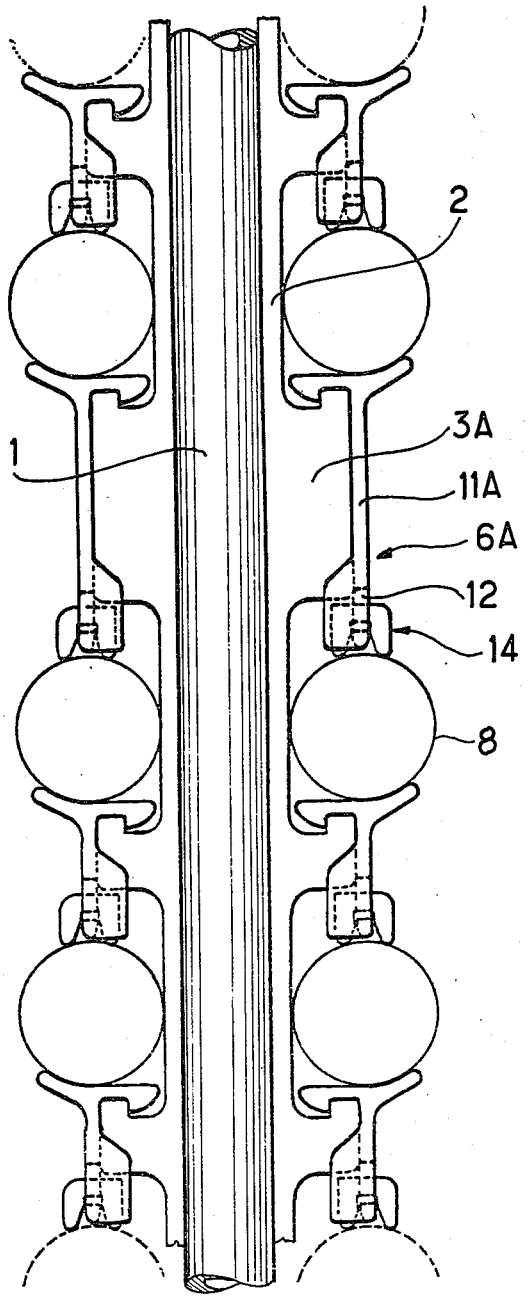
FIG. 3 is an elevational view which illustrates a profile of various parts of the panel and to the corresponding parts which form latches, with a few tubes two pairs of which are spaced further apart than the other tubes.

FIG. 3 illustrates a tube fixing means analogous to that in FIGS. 1 and 2 which is placed in a zone where two adjacent tubes are farther apart than the other tubes, their spacing corresponding e.g. to the boundary between two different portions of the panel of tubes. The parts 6 which form latches are replaced at this level by parts 6A with longer vertical shoes 11A which lie against the lip 3A of a shoulder. Dogs 14 identical to the others engage in holes 12 in the parts 6A which holes are identical to those of the other parts which form latches.

Although the fixing device which has just been described with reference to the figures of the drawing appears to be the preferable embodiment of the invention, it will be understood that various modifications can be made thereto without going beyond the scope of the invention, it being possible to replace some of its components by others which can perform an analogous technical function.

The invention applies to fixing all panels of horizontal or slightly inclined heat exchange tubes which are straight or helically coiled at a short pitch.

We claim:

1. A device for fixing a panel of horizontal or slightly inclined heat exchange tubes on vertical tubes or beams provided with longitudinal fins, wherein the device includes:

means defining a series of vertically spaced horizontal shoulders on the longitudinal fins of each vertical tube or beam, said shoulders having upwardly projecting rims at their ends remote from said vertical tubes or beams;

a series of parts which form latches having upper surfaces which are substantially flat on one side and which rise on the other side in a circle with a radius of curvature equal to or slightly greater than that of the radius of said horizontal tubes, the parts which form latches having, under the substantially flat sides of their upper surfaces middle portions, noses which are separated from said middle portions by recessed portions, said recessed portions fitting into the projecting rims of the shoulders, vertical shoes in planes at 90° to the planes of vertical symmetry of said parts, said shoes being of nearly the same vertical height as the rims of the shoulders and having in their bottoms holes whose axes are perpendicular to their longitudinal axes; and a series of dogs whose dimensions are such as to allow them to be installed in said holes of the parts which form latches and being positioned therein, each dog having downwardly projecting legs whose height is such that their ends come into contact with the upper portion of a horizontal tube which rests on the upper surface of the part which forms a latch immediately below when inserted in said holes, and a side rim in its upper portion such that when urged upwards, the dog abuts against the lower surface of the shoulder on which the part which forms a latch is fixed with the dog engaged in a hole in the shoulder.

2. A device according to claim 1, wherein the vertical spacing of two shoulders, the width of the circular outer portion of the shoe of a part which forms a latch for the upper of the two shoulders, and the height of the legs of a dog are such that a tube cannot become unfixed from said fixing device under the effect of a force which tends to move it away from the vertical tube beam without the upper side rim of a dog abutting against the lower surface of the corresponding shoulder, and wherein the height of the legs of a dog is such that the clearance between the side rim of said dog and the lower surface of the shoulder is at the most equal to half the contact height of the nose of the part which forms a latch with the lip of the shoulder.

3. A device according to claim 1 or 2, wherein the vertical shoe of each part which forms a latch is provided with two flanges by which it straddles the sides of the shoulder on which said part which forms a latch a fixed.

4. A device according to claim 2, wherein the dogs are made of a substance which is consumable at the temperature of the enclosure in which the panel of tubes is required to operate.

5. A device according to claim 1 or claim 2, wherein above the place occupied by the highest horizontal tube said device includes a part with a concave cylindrical lower edge profile whose radius of curvature is substantially equal to that of the horizontal tube, and said part being welded on the fin of the vertical tube the beam so as to lock the panel of horizontal tubes in position.

* * * * *